US010842187B2

(12) United States Patent
Akin, Jr.

(10) Patent No.: US 10,842,187 B2
(45) Date of Patent: Nov. 24, 2020

(54) HUMIDOR WITH IMPROVED MOISTURE CONTROL

(71) Applicant: Robert A. Akin, Jr., Fort Worth, TX (US)

(72) Inventor: Robert A. Akin, Jr., Fort Worth, TX (US)

( * ) Notice: Subject to any disclaimer, the term of this patent is extended or adjusted under 35 U.S.C. 154(b) by 214 days.

(21) Appl. No.: 15/793,196

(22) Filed: Oct. 25, 2017

(65) Prior Publication Data

US 2019/0116878 A1 Apr. 25, 2019

(51) Int. Cl.
*A24F 25/02* (2006.01)

(52) U.S. Cl.
CPC ..... *A24F 25/02* (2013.01)

(58) Field of Classification Search
CPC ..... B65D 81/3266
USPC ..... 220/705, 530, 709, 592.17, 592.16, 529, 220/501, 503, 505–507, 669, 623, 608, 220/62.2, 62.11, 794, 378, 849, 23.9; 383/37, 35, 104, 38–40, 123; 53/449; 206/221, 484, 213.1, 204, 14, 314, 545; 229/103.1; 131/329, 242; 261/101, 261/64–95; 312/31, 31.1
See application file for complete search history.

(56) References Cited

U.S. PATENT DOCUMENTS 1,268,163 A * 6/1918 Schneider ..... B65D 81/266 220/23.87
D396,732 S 8/1998 Bucher
5,829,451 A * 11/1998 Barber ..... A24F 25/02 131/250
5,970,987 A * 10/1999 Barreiro, Jr. ..... A24F 25/02 131/328
D416,105 S 11/1999 Garrison et al.
6,068,113 A 5/2000 Schmaling et al.
6,112,889 A 9/2000 Wicker
6,116,029 A * 9/2000 Krawec ..... A24F 25/02 62/3.3
6,615,841 B2 9/2003 DeLoach
6,752,092 B2 * 6/2004 Beattie ..... E05G 1/005 109/73
7,287,306 B1 * 10/2007 Green ..... A61G 17/08 27/1
8,178,854 B1 * 5/2012 Elliott ..... A24F 25/02 131/250
2009/0014019 A1 * 1/2009 Park ..... A24F 25/00 131/328

* cited by examiner

*Primary Examiner* — J. Gregory Pickett
*Assistant Examiner* — Tia Cox
(74) *Attorney, Agent, or Firm* — Dan Brown Law Office; Daniel R. Brown

(57) ABSTRACT

A humidor with improved moisture control. A box and liner are provided with a circumferential seam separating a lower portion and an upper portions that engage along upper and lower edges, which each have a curvilinear cross section profile. The curvilinear profiles define convex cylindrical portions joined with concave cylindrical portions along the edges. The lower edge profiles and the upper edges profiles are aligned to cooperatively and correspondingly engage the concave cylindrical portions with the convex cylindrical portions between the upper edges and the lower edges while the upper portion is disposed on the lower portion, to thereby form a circuitous path against the movement of air and moisture.

16 Claims, 6 Drawing Sheets

HUMIDOR WITH IMPROVED MOISTURE CONTROL

REFERENCE TO RELATED APPLICATIONS

None.

BACKGROUND OF THE INVENTION

Field of the Invention

The present invention relates to humidors, more particularly, the present invention relates to humidors with improved humidity control.

Description of the Related Art

Humidors have been in use for many years, and are widely utilized for storage of tobacco products, with cigar storage being a prominent application. In addition to providing a secure storage space for tobacco products, humidors are intended to control the relative humidity of the storage space so as to preserve the quality, freshness, and flavor of the tobacco products. The generally accepted range of humidity is between 65% and 72% relative humidity, however, a preferred range is 68 to 70% relative humidity. It is further noted that temperature also needs to be controlled, not exceeding 75° F. nor dropping below 54° F., to preserve tobacco quality, enhance beneficial tobacco aging, and prevent the growth of parasites. A moisture source, such as a humidifier, is commonly disposed within the humidor to provide additional moisture, as moisture is lost from the humidor. The humidifier must be supplied with water, and optional supplemental fluids, so as to prevent humidity loss and drying of the tobacco products. The prevention of moisture loss is dependent upon the overall control of air circulation in and out of the humidor. However, a completely sealed humidor is not preferred because relative humidity is dependent upon temperature as well as absolute moisture levels. In other words, a high performance humidor must 'breath' to control moisture content as a function of temperature, but not be so 'open' as to unduly accelerate moisture losses. At the same time, a humidor must provide access to a user through a convenient opening.

The materials of construction of humidors are selected to enhance humidity control, minimize moisture loss, maintain flavors, and also enhance flavors. It is well known that cedar wood is beneficial for controlling moister, with Spanish cedar being the prevalent choice. The known benefits of Spanish cedar are its ability to hold more moisture than most woods, its naturally pleasing aroma, which enhances tobacco aroma, its tolerance of high humidity levels, and that it repels certain tobacco parasites. It should be noted that most humidors are not fabricated from solid cedar, but rather are lined with cedar. This is due, in part, to cost concerns and to the porous nature of cedar, which would allow too much moisture to be lost over time if there were no other barrier to moisture movement. Therefore, an exterior box may be employed, which may be fabricated from a natural and synthetic material that is more impervious to moisture lost, but not so much as to prevent beneficial breathing of the humidor.

All humidors include a cover or opening through which tobacco products are inserted and removed, as well as for servicing a humidifier placed therein. Such an opening requires a joint between the two portions of the humidor enclosure. This joint has a direct effect on the moisture seal and breathing between the interior and exterior of the humidor. Given the foregoing desirable aspects of moisture control and controlled breathing, it can be appreciated that there is a need in the art for an improved humidor design that addresses the problems in the prior art.

SUMMARY OF THE INVENTION

The need in the art is addressed by apparatus of the present invention. The present disclosure teaches a humidor with improved moisture control. The humidor includes a box with a flat base and plural lower sides extending upwardly therefrom, and a cover with a top and plural upper sides extending downwardly therefrom. A box liner with plural lower panels is disposed adjacent the plural lower sides, where each of the plural lower panels have an upper edge. A cover liner with plural upper panels is disposed adjacent the plural upper sides, where each of the plural upper panels having a lower edge. The plural upper edges and the plural lower edges each have a curvilinear cross section profile, generally following an "S" shape, which defines a convex cylindrical portion joined with a concave cylindrical portion along each of the plural lower edges and each of the plural upper edges. The lower edges profiles and the upper edges profiles are aligned to cooperatively and correspondingly engage the concave cylindrical portions with the convex cylindrical portions between the upper edges and the lower edges while the cover is disposed on the box, to thereby form a circuitous path between the upper edges and the lower edges against the movement of air and moisture.

In a specific embodiment of the foregoing humidor, the plural upper panels and the plural lower panels each comprise two opposing parallel surfaces, and the curvilinear cross section profiles intersect the two opposing parallel surfaces of the plural upper panels and the plural lower panels at substantially right angles.

In a specific embodiment of the foregoing humidor, the cover liner further includes a ceiling disposed adjacent the top, and the box liner further comprises a floor disposed adjacent the flat base. In another specific embodiment, a hinge is disposed between the box and the cover.

In a specific embodiment of the foregoing humidor, the box liner and the cover liner are fabricated from unfinished cedar wood, and, the box and the cover are fabricated from hardwood that is finished to prevent the movement of moisture therethrough.

In a specific embodiment of the foregoing humidor, the box is rectangular with four of the plural lower sides, and the cover is rectangular with four of the plural upper sides. In another specific embodiment, a humidifier disposed within the humidor.

In a specific embodiment of the foregoing humidor, the box liner is glued to the box, and the cover liner is glued to the cover. In another specific embodiment, the convex cylindrical portion is joined with the concave cylindrical portion by a substantially planar portion.

The present disclosure also teaches a humidor with improved moisture control, which includes a box with a bottom, a top, and four side walls disposed therebetween, and includes a liner disposed within the box that is fabricated from plural panels, including four side panels adjacent to the four side walls. The four side walls and the four side panels are detached along a circumferential seam around the box to define an upper portion of the box terminated by a lower edge that engages a lower portion of the box terminated by an upper edge. The upper edge and the lower edge each have a profile that has a curvilinear cross section, generally following an "S" shape, which defines a convex cylindrical portion joined with a concave cylindrical portion along the circumferential seam. The lower edge profile and the upper edge profile are aligned to cooperatively and correspondingly engage the concave cylindrical portions with the convex cylindrical portions between the upper edge and the lower edge along the circumferential seam while the upper portion of the box is disposed upon the lower portion of the box, to thereby define a circuitous path therebetween against the movement of air and moisture through the circumferential seam.

In a specific embodiment of the foregoing humidor, the four side walls and the four side panels include two opposing parallel surfaces, and the curvilinear cross section intersect the two opposing parallel surfaces at substantially right angles. In another specific embodiment, a hinge is disposed between the upper portion of the box and the lower portion of the box, and positioned to maintain substantial alignment of the upper edge and the lower edge.

In a specific embodiment of the foregoing humidor, the liner is fabricated from unfinished cedar wood, and the box is fabricated from hardwood that is finished to prevent the movement of moisture therethrough. In another specific embodiment, the liner is glued to the box.

In a specific embodiment of the foregoing humidor, a humidifier disposed within the humidor. In another specific embodiment, the convex cylindrical portion is joined with the concave cylindrical portion by a substantially planar portion.

DESCRIPTION OF THE INVENTION

Figure 1:
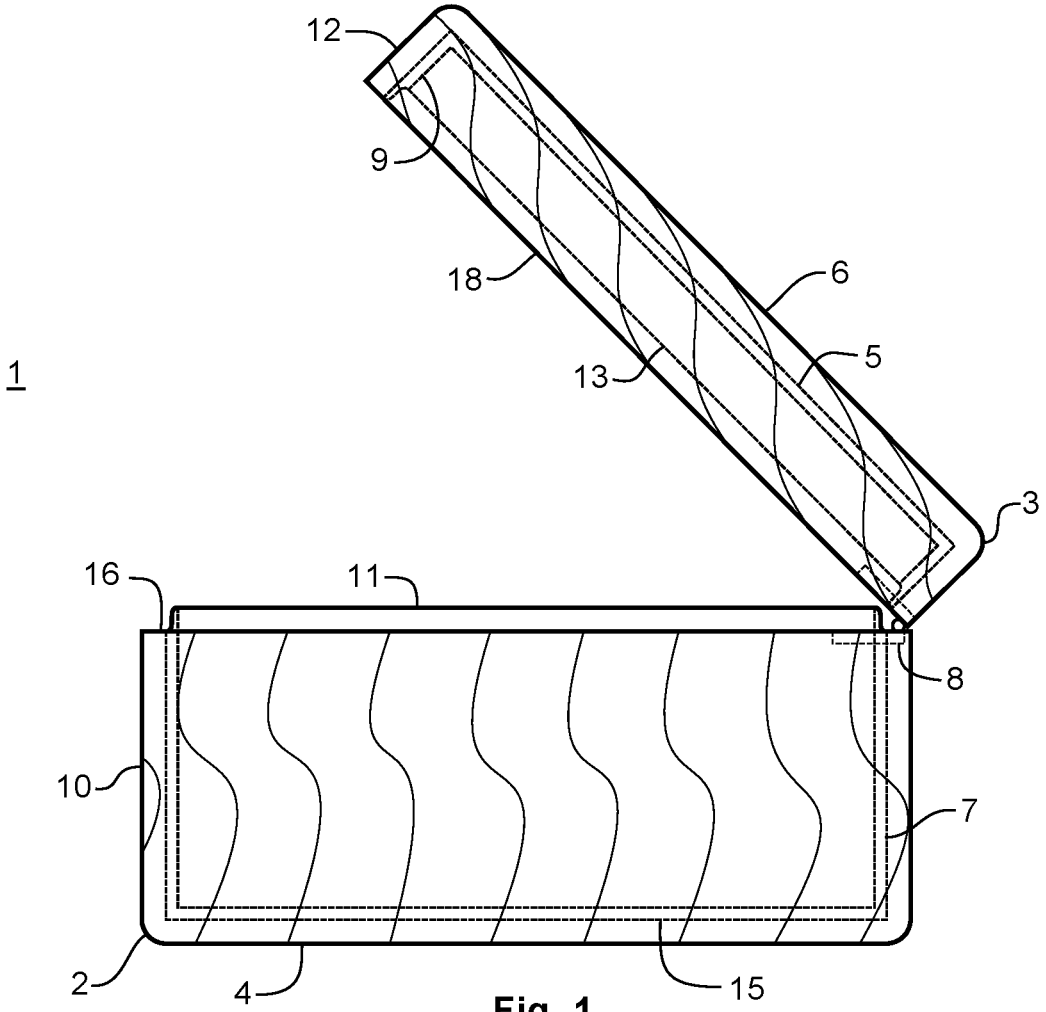
FIG. 1 is a side view of a humidor with the cover open according to an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof and additional fields in which the present invention would be of significant utility.

In considering the detailed embodiments of the present invention, it will be observed that the present invention resides primarily in combinations of steps to accomplish various methods or components to form various apparatus. Accordingly, the apparatus components and method steps have been represented where appropriate by conventional symbols in the drawings, showing only those specific details that are pertinent to understanding the present invention so as not to obscure the disclosure with details that will be readily apparent to those of ordinary skill in the art having the benefit of the disclosures contained herein.

In this disclosure, relational terms such as first and second, top and bottom, upper and lower, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a" does not, without more constraints, preclude the existence of additional identical elements in the process, method, article, or apparatus that comprises the element.

The present disclosure teaches a humidor configured as a box that opens along a seam between corresponding edges of two box portions. The edges are configured with a curvilinear cross section, generally following a "S" shape, that cooperatively engage one another to provide a circuitous path against the movement of air and moisture between the interior of the humidor and its exterior. In one embodiment, this circuitous path is through a cedar box liner comprised of plural panels. The edges are configures with a convex cylindrical portion and a concave cylindrical portion, such that the opposing edges along the seam correspondingly engage one another concave to convex, and convex to concave, cylindrical portions. A substantially planar portion may be employed to separate the cylindrical portions of a given edge. A benefit of the curvilinear edge profile is that an effective seal is provided even when the edges are slightly misaligned either vertically, horizontally, or when joined at a slightly skewed angle. This arrangement assure good moisture control characteristics over time and even after the humidor box shape may be somewhat distorted through use or abuse.

In certain embodiments, the sidewalls of the humidor comprise parallel surfaces, and the curvilinear cross-section of the edge profiles engages the parallel surfaces at substantially right angles. The illustrative embodiment presented herein illustrates a rectangular humidor, however it is understood that the edge seal arrangement could be applied to any 'N'-sided polygon box as well as enclosures with arcuate surfaces. Additionally, it is to be noted that the seam could be applied about the humidor box along any surface or surfaces that define a suitable opening for accessing the contents of the humidor.

Figure 2:
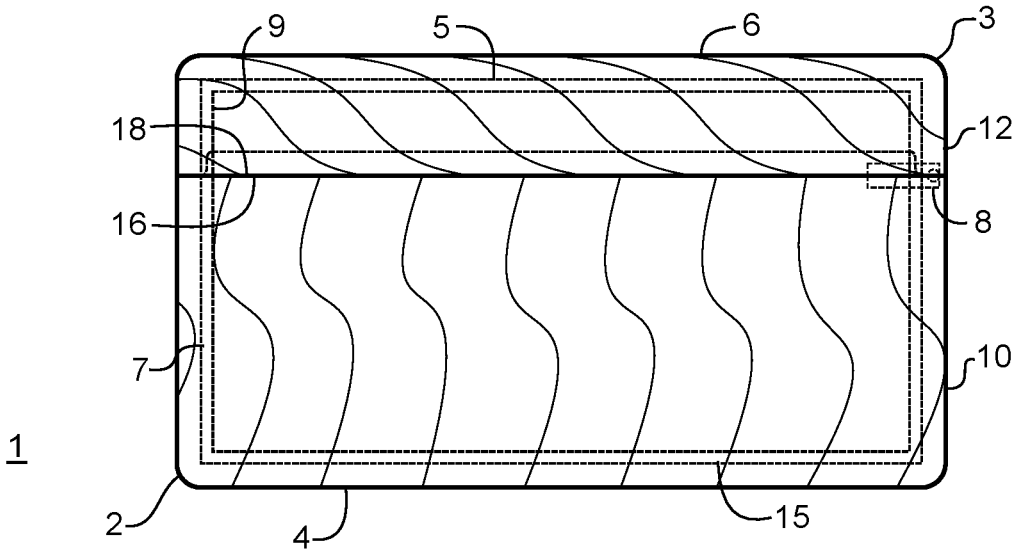
FIG. 2 is a side view of a humidor with the cover closed according to an illustrative embodiment of the present invention.

Reference is directed to FIG. 1 and FIG. 2, which are a side view of a humidor 1 with a box 2 and a cover 3 that is open in FIG. 1 and closed in FIG. 2, according to an illustrative embodiment of the present invention. The box 2 has an exterior comprising a flat base 4 with plural lower sides 10. The plural lower sides 10 each terminate with an upper edge 16. This embodiment presents a rectangular humidor, so there are four sides 10. Disposed within the box 2 is a box liner comprising a floor 15 and plural lower panels 7, each of which terminate with an upper curvilinear edge 11. The box 2 is connected to the cover 3 by a pair of hinges 8. The cover 3 comprises a top 6 with plural upper sides 12 that terminate at a lower edge 18. Disposed within the cover 3 is a cover liner comprising a ceiling 5 and plural upper panels 9 each of which terminate with a lower curvilinear edge 13.

Note in FIGS. 1 and 2 that the box lower sides 10 upper edges 16 are square to the parallel side surfaces 10, and that the cover upper sides 12 lower edges 18 are also square to the upper sides 12 parallel surfaces. The box liner lower panels 7 upper curvilinear edges 11 extend above the sides 10. The cover liner plural upper side panels 9 lower curvilinear edges 13 are recessed above the lower edges 18 of the upper sides 12. This is a design choice, and it would also be suitable for the lower curvilinear edges 18 to extend down and the upper curvilinear edge 11 to be recessed. When the cover 3 is closed against the box 2, and held in alignment by the hinges 8, the upper curvilinear edge 11 engages the lower curvilinear edge 13 to provide a circuitous path against the movement of moisture and air, as will be more fully discussed hereinafter.

Figure 3:
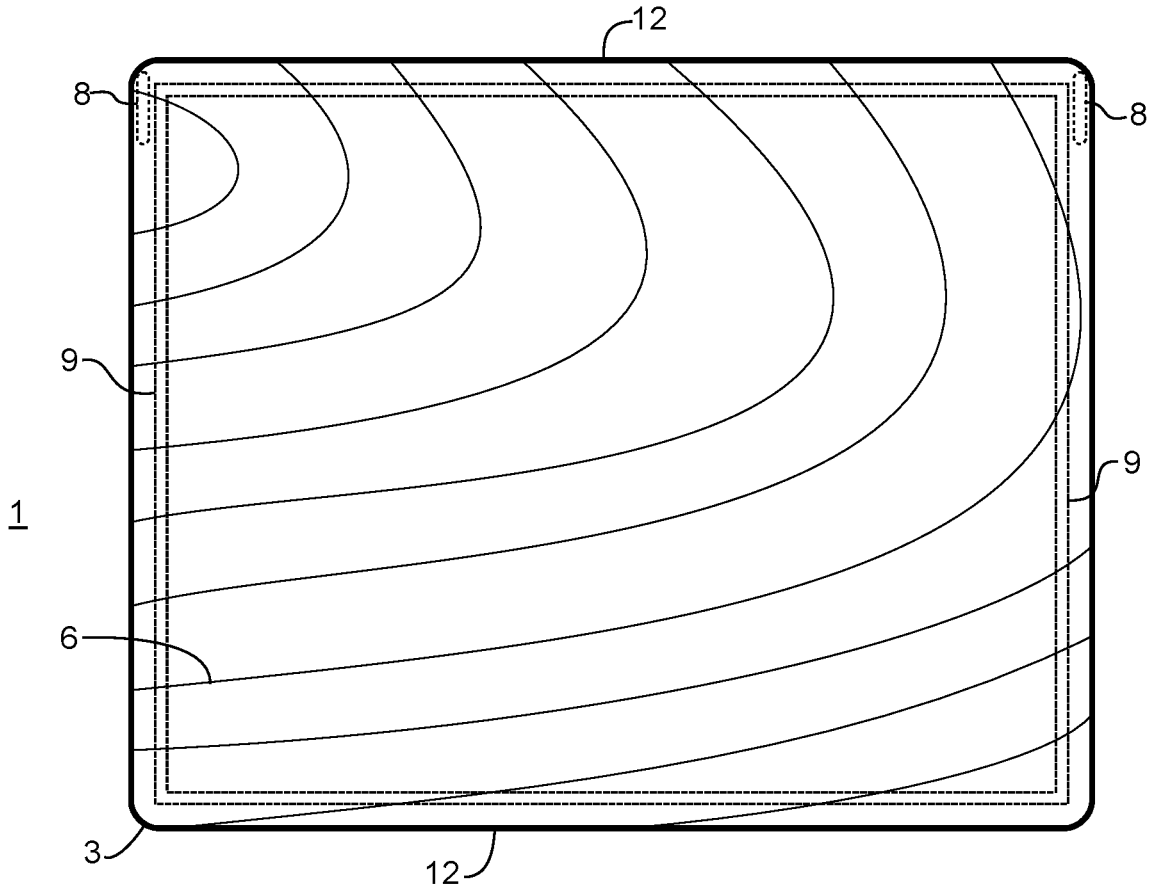
FIG. 3 is a top view of a humidor according to an illustrative embodiment of the present invention.
Figure 4:
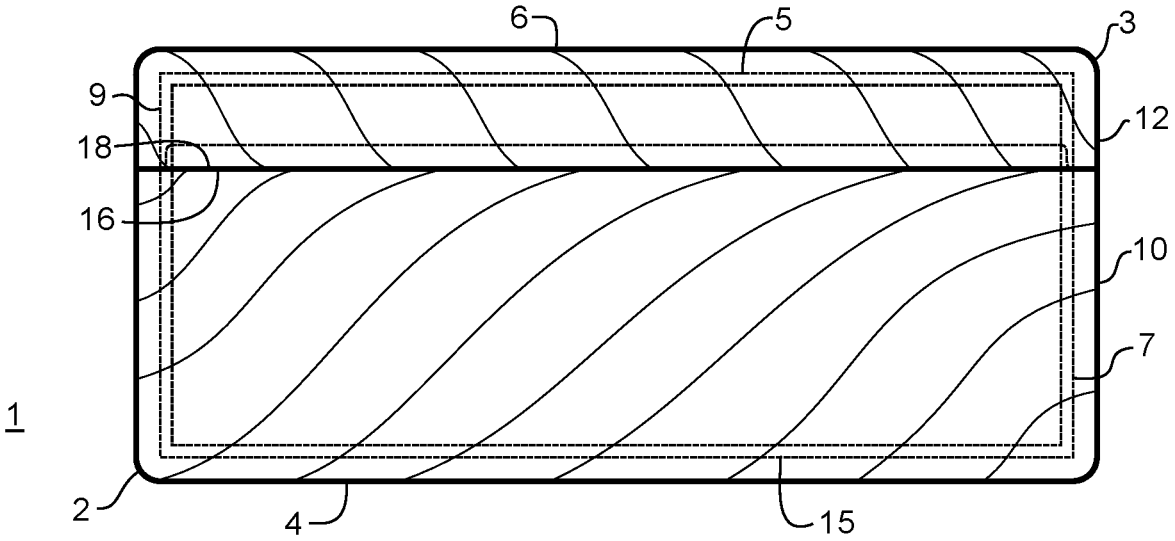
FIG. 4 is a front view of a humidor according to an illustrative embodiment of the present invention.

Reference is directed to FIG. 3 and FIG. 4, which are a top view of a humidor 1 and a front view of a humidor 1, respectively, according to an illustrative embodiment of the present invention. The box 2 has an exterior comprising a flat base 4 with plural lower sides 10. The plural lower sides 10 each terminate with an upper edge 16. Disposed within the box 2 is a box liner comprising a floor 15 and plural lower panels 7, each of which terminate with an upper curvilinear edge 11. The box 2 is connected to the cover 3 by a pair of hinges 8. The cover 3 comprises a top 6 with plural upper sides 12 that terminate at a lower edge 18. Disposed within the cover 3 is a cover liner comprising a ceiling 5 and plural upper panels 9, each of which terminate with a lower curvilinear edge 13. These views define the overall structure of the rectangular humidor 1 according to this illustrative embodiment of the present invention.

In this illustrate embodiment, the box 2 and cover 3 are fabricated from select hardwood, such as walnut or mahogany, which are joined with cabinetry building techniques know to those skilled in the art, and may include joinery such as butt joints, mitered butt joints, half-lap joints, tongue and groove joints, mortise and tenon joints, biscuit joints, pocket joints, dado joints, rabbet joints, dovetail joints, box joints, or other joints known to those skilled in the arts of cabinetry making. The joints may be secured with glue or various types of mechanical fasteners, as are known to those skilled in the art. The liners in the illustrative embodiment are fabricated from Spanish cedar panels fitted to the interior of the box and cover. The liners may utilize similar joinery as the box and cover. The liners may be press fitted, glued in place, or secured with mechanical fasteners.

Figure 5:
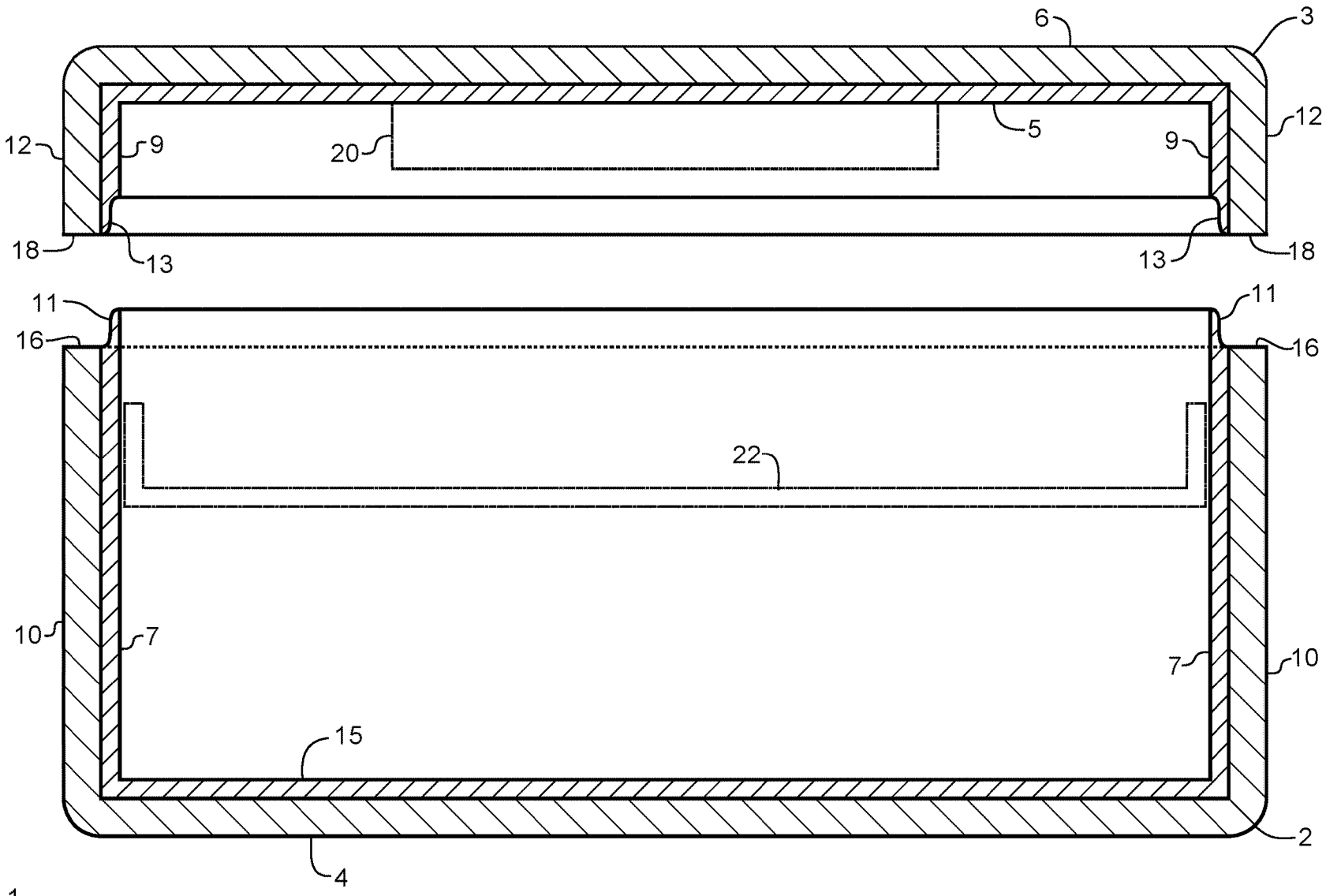
FIG. 5 is a section view of a humidor according to an illustrative embodiment of the present invention.

Reference is directed to FIG. 5, which is a section view of a humidor 1 according to an illustrative embodiment of the present invention. This view shows both the box 2 and the cover 3 in section view. The box 2 exterior comprises a flat base 4 with plural lower sides 10. The plural lower sides 10 each terminate with an upper edge 16, which is a flat surface in this embodiment. Disposed within the box 2 is the box liner comprising the floor 15 and plural lower panels 7, each of which terminate with an upper curvilinear edge 11. The cover 3 comprises the top 6 with plural upper sides 12 that terminate at a lower edge 18, which is also flat and which engages the upper edge 16 of the lower sides 10 when the humidor 1 is closed. Disposed within the cover 3 is the cover liner comprising the ceiling 5 and plural upper panels 9, each of which terminate with a lower curvilinear edge 13. The box liner lower panels 7 upper curvilinear edges 11 extend above the sides 10. The cover liner plural upper side panels 9 lower curvilinear edges 13 are recessed above the lower edges 18 of the upper sides 12. When the cover 3 is closed against the box 2, the upper curvilinear edge 11 engages the lower curvilinear edge 13 to provide a circuitous path against the movement of moisture and air, as will be more fully discussed hereinafter.

In the illustrative embodiment of FIG. 5, an internal shelf 22 is provided to support contents, such as plural cigars. The internal shelf 22 may also be fabricated from Spanish cedar. Also disposed within the humidor 1 is a humidifier 20, which is fixed to the top 5 of the cover liner. Humidifiers suitable for use in a humidor are known to those skilled in the art, and may be located anywhere within the interior of the humidor 1, as a matter of design choice.

Figure 6:
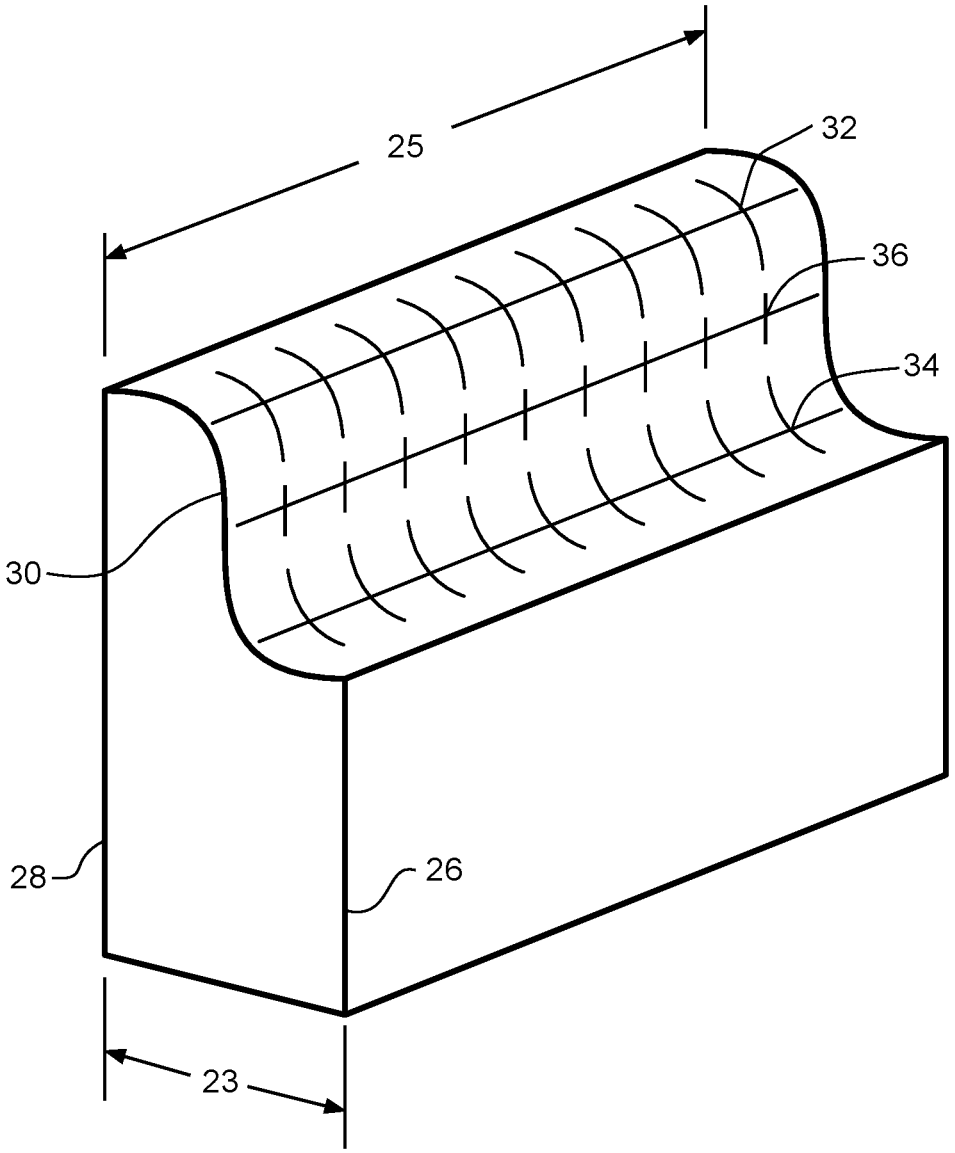
FIG. 6 is a detailed perspective view of a humidor sidewall and edge illustrating a curvilinear profile according to an illustrative embodiment of the present invention.
Figure 7:
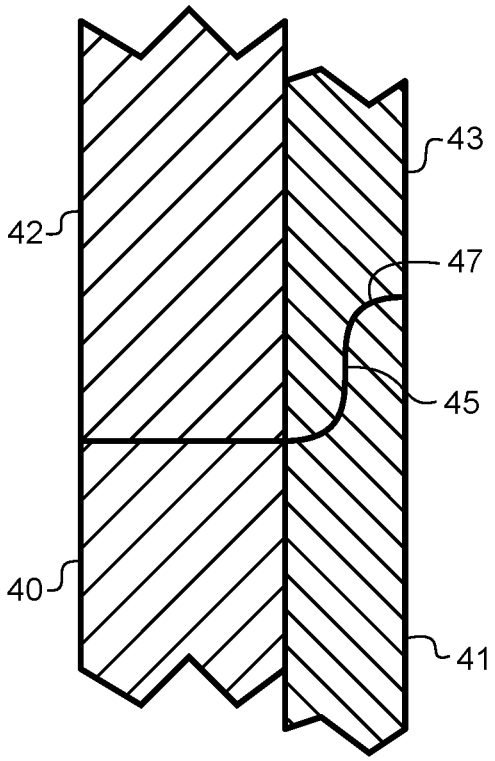
FIG. 7 is a section view of box and liner edges aligned along a circumferential seam according to an illustrative embodiment of the present invention.

Reference is directed to FIG. 6, which is a detailed perspective view of a humidor sidewall 28 and edge 30 illustrating a curvilinear profile according to an illustrative embodiment of the present invention. The sidewall 28 has an edge 30 having a curvilinear profile that generally has an "S" shape. This profile 30, as taken along the length 25 of the sidewall, defines a convex cylindrical portion 32 and a concave cylindrical portion 34 along its length 25. These cylindrical portions 32, 34 may be separated by a planar portion 36, which can be as tall as the designer may prefer. The sidewall 28 is generally planar and has a thickness 23, to a second parallel surface 26 in this illustrative embodiment. Note also that the cylindrical portions engage the sides 28, 26 at a substantially right angle in his embodiment. Other angles of engagement can also be employed, provided that the curvilinear profile 30 implements a curvilinear path along its surface and that the humidor can be opened and closed along the intended seam of engagement. This is a feature of the profile that controls air and moisture movement along the seam created when two of the profiles a cooperatively engaged. The circuitous path offers a more resistive path to the movement of air and moisture than presented in prior art humidor designs.

Figure 9:
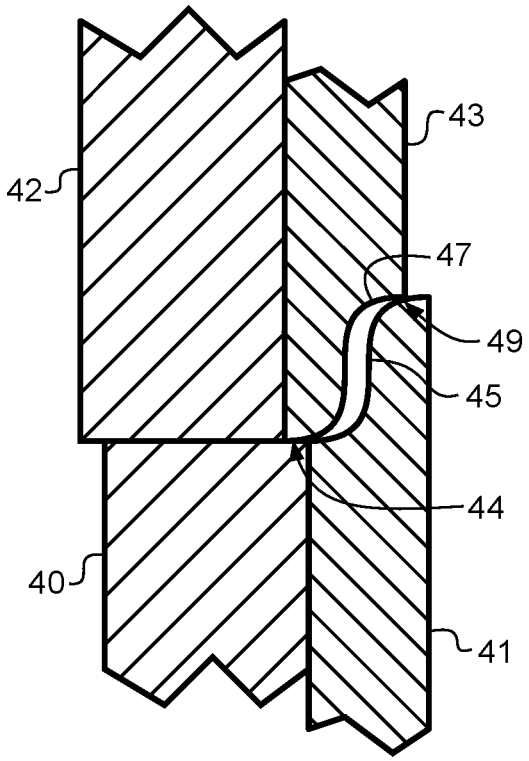
FIG. 9 is a section view of box and liner edges misaligned along a circumferential seam according to an illustrative embodiment of the present invention.
Figure 8:
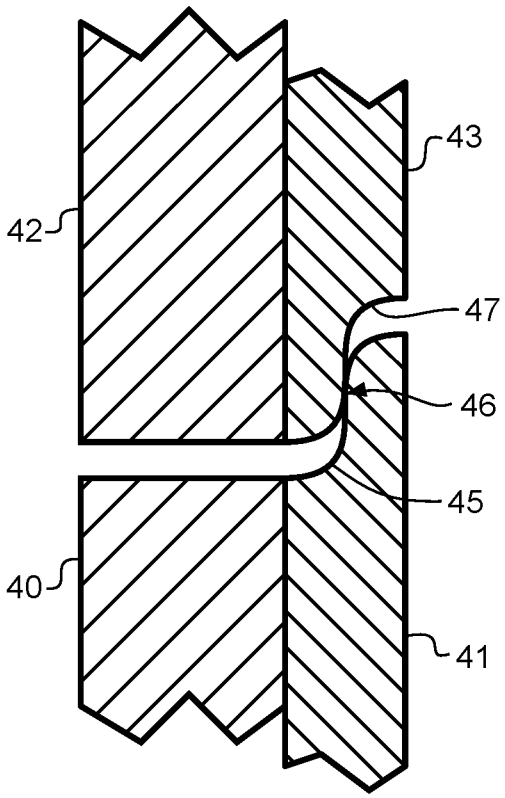
FIG. 8 is a section view of box and liner edges misaligned along a circumferential seam according to an illustrative embodiment of the present invention.
Figure 10:
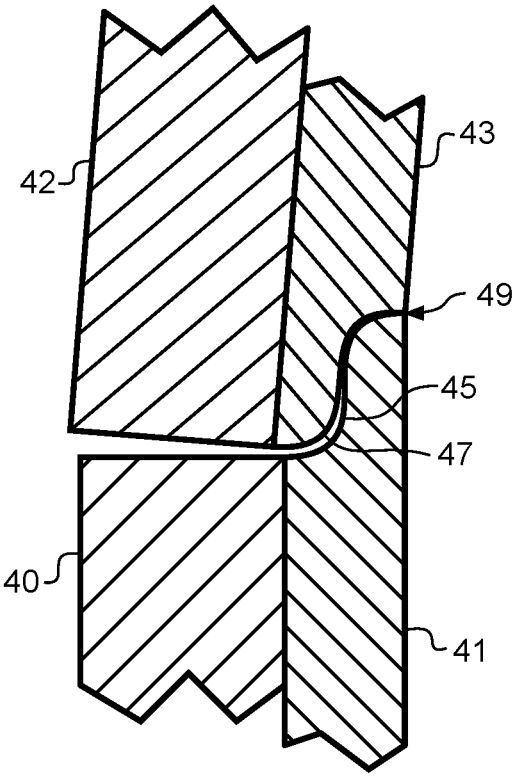
FIG. 10 is a section view of box and liner edges misaligned along a circumferential seam according to an illustrative embodiment of the present invention.

Reference is directed to FIG. 7, FIG. 8, FIG. 9, and FIG. 10, which are section view drawings of box and liner edges aligned along a circumferential seam according to an illustrative embodiment of the present invention. The humidor box is presented as upper side 42 engaging lower side 40 with square edges as illustrated. The liners are presented as upper panel 43 engaging lower panel 41 along cooperative curvilinear edges 47 and 45, respectively in each of these drawings FIG. 7 through FIG. 10. Note that the curvilinear edges could be applied to the side edges of the box or the liner panels, or across the two layers combined together. A significant feature of the illustrative embodiment is illustrated in these drawing FIGS. 7 through 10. Note that in FIG. 7, the curvilinear edges are fully mated in a cooperative fashion such that the concave and convex portion fully engage one another as discussed hereinbefore. This provides the aforementioned circuitous path. One problem in the prior art designs occurs where there is a misalignment in a humidor seam, which opens the seam allowing excessive air and moisture to circulate, thereby quickly depleting moisture reserves. This can occur where the humidor is flexed, warps, of has some other interference with is closure functions. The present disclosure teaches solutions to these issues, as illustrated in FIGS. 8, 9, and 10.

In FIG. 8, the upper and lower sidewalls 42, 40 are not fully engaged, indicating that the humidor is not fully closed. However, since the curvilinear edges 45, 47 has the aforementioned planar portion between the two cylindrical portions, a line of contact 46 is maintained, and the seam is not opened to the free movement of air and moisture. This action protects the contents of the humidor from unexpected loss of moisture and degrading the quality of the tobacco stored therein. In this manner, the moisture level is controlled, the moisture reserve in the humidifier is not depleted in an accelerated manner, and the tobacco is protected.

In FIG. 9, the upper side 42 and lower side 40 are displaced laterally, indicating a misalignment of the humidor closure. However, since the liner edges 45, 47 employ the curvilinear profile of the illustrative embodiment, two points of contact 44, 47 are maintained, and the seam is not opened to the free movement of air and moisture. This action protects the contents of the humidor from unexpected loss of moisture and degrading of the tobacco stored therein. In this manner, the moisture level is controlled, the moisture reserve in the humidifier is not depleted in an accelerated manner, and the tobacco is protected.

In FIG. 10, the upper side 42 and lower side 40 are displaced angularly, indicating a misalignment of the humidor structure. However, since the liner edges 45, 47 employ the curvilinear profile of the illustrative embodiment, a point of contact 49 is maintained, and the seam is not opened to the free movement of air and moisture. This action protects the contents of the humidor from unexpected loss of moisture and degrading of the tobacco stored therein. In this manner, the moisture level is controlled, the moisture reserve in the humidifier is not depleted in an accelerated manner, and the tobacco is protected.

Figure 11:
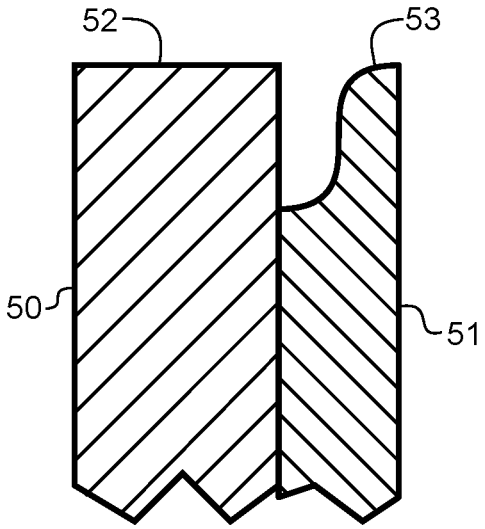
FIG. 11 is a section view of box and liner edges according to an illustrative embodiment of the present invention.
Figure 12:
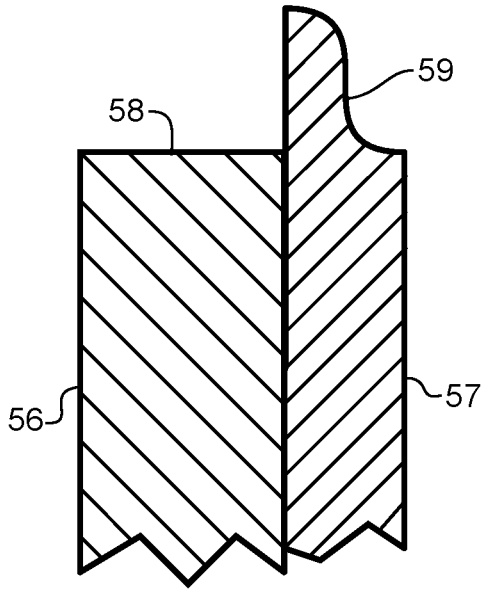
FIG. 12 is a section view of box and liner edges according to an illustrative embodiment of the present invention.
Figure 13:
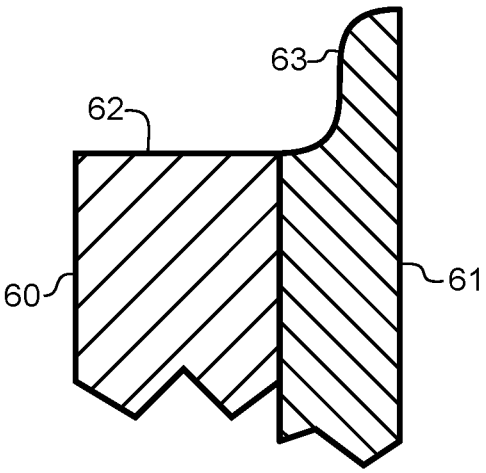
FIG. 13 is a section view of box and liner edges according to an illustrative embodiment of the present invention.
Figure 14:
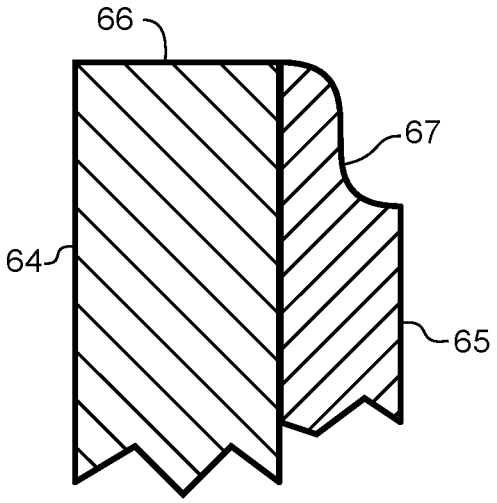
FIG. 14 is a section view of box and liner edges according to an illustrative embodiment of the present invention.

Reference is directed to FIG. 11, FIG. 12, FIG. 13, and FIG. 14, which are a section view drawings of box sides and liner edges according to illustrative embodiments of the present invention. These Figures illustrate several of the many possible arrangements of the curvilinear edges and the box sidewalls. In FIG. 11, the liner curvilinear edge 53 is flush with the sidewall 50 edge 52, with the curvilinear surface facing toward the sidewall 50. In FIG. 12, the liner curvilinear edge 59 extends beyond the sidewall 56 edge 58, with the curvilinear surface facing away the sidewall 56. In FIG. 13, the liner curvilinear edge 63 extends beyond the sidewall 60 edge 62, with the curvilinear surface facing toward the sidewall 60. In FIG. 14, the liner curvilinear edge 67 is flush with the sidewall 64 edge 66, with the curvilinear surface facing away the sidewall 64. As will be appreciated by those skilled in the art, the complementary and corresponding sidewall and liner edge configuration would be employed to perfect the circuitous seal of the illustrative embodiments.

Thus, the present invention has been described herein with reference to a particular embodiment for a particular application. Those having ordinary skill in the art and access to the present teachings will recognize additional modifications, applications and embodiments within the scope thereof It is therefore intended by the appended claims to cover any and all such applications, modifications and embodiments within the scope of the present invention.

What is claimed is:

1. A humidor with improved moisture control, comprising:

a box having a flat base with plural lower sides extending upwardly therefrom;

a cover having a top with plural upper sides extending downwardly therefrom;

a box liner comprising plural lower panels correspondingly disposed adjacent said plural lower sides, each of said plural lower panels having an upper edge;

a cover liner comprising plural upper panels correspondingly disposed adjacent said plural upper sides, each of said plural upper panels having a lower edge, and wherein said plural upper edges and said plural lower edges have a curvilinear cross section profile, generally following an "S" shape, which defines a convex cylindrical portion joined with a concave cylindrical portion along each of said plural lower edges and each of said plural upper edges, and wherein said lower edges profiles and said upper edges profiles are aligned to cooperatively and correspondingly engage said concave cylindrical portions with said convex cylindrical portions between said upper edges and said lower edges while said cover is disposed on said box, to thereby form a circuitous path between said upper edges and said lower edges against the movement of air and moisture.

2. The humidor of claim 1, and wherein:

said plural upper panels and said plural lower panels each comprise two opposing parallel surfaces, and wherein said curvilinear cross section profiles intersect said two opposing parallel surfaces of said plural upper panels and said plural lower panels at substantially right angles.

3. The humidor of claim 1, and wherein:

said cover liner further comprises a ceiling disposed adjacent said top, and wherein said box liner further comprises a floor disposed adjacent said flat base.

4. The humidor of claim 1 further comprising:

a hinge disposed between said box and said cover.

5. The humidor of claim 1, and wherein:

said box liner and said cover liner are fabricated from unfinished cedar wood, and wherein said box and said cover are fabricated from hardwood having a finish that prevents the movement of moisture therethrough.

6. The humidor of claim 1, and wherein:

said box is rectangular having four of said plural lower sides, and wherein said cover is rectangular having four of said plural upper sides.

7. The humidor of claim 1, further comprising:

a humidifier disposed therein.

8. The humidor of claim 1, and wherein:

said box liner is glued to said box, and wherein said cover liner is glued to said cover.

9. The humidor of claim 1, and wherein:

said convex cylindrical portion is joined with said concave cylindrical portion by a substantially planar portion.

10. A humidor with improved moisture control, comprising:

a box including a bottom, a top, and four side walls disposed therebetween;

a liner disposed within said box, and fabricated from plural panels, including four side panels adjacent to said four side walls, and wherein said four side walls and said four side panels are detached along a circumferential seam about said box to define an upper portion of said box terminated by a lower edge that engages a lower portion of said box terminated by an upper edge, and wherein said upper edge and said lower edge each have a profile that has a curvilinear cross section, generally following an "S" shape, which defines a convex cylindrical portion joined with a concave cylindrical portion along said circumferential seam, and wherein said lower edge profile and said upper edge profile are aligned to cooperatively and correspondingly engage said concave cylindrical portions with said convex cylindrical portions between said upper edge and said lower edge along said circumferential seam while said upper portion of said box is disposed upon said lower portion of said box, to thereby define a circuitous path therebetween against the movement of air and moisture through said circumferential seam.

11. The humidor of claim 10, and wherein:

said four side walls and said four side panels comprise two opposing parallel surfaces, and wherein said curvilinear cross section intersect said two opposing parallel surfaces at substantially right angles.

12. The humidor of claim 10 further comprising:

a hinge disposed between said upper portion of said box and said lower portion of said box, and positioned to maintain substantial alignment of said upper edge and said lower edge.

13. The humidor of claim 10, and wherein:

said liner is fabricated from unfinished cedar wood, and wherein said box is fabricated from hardwood having a finish that prevents the movement of moisture therethrough.

14. The humidor of claim 10, and wherein:

said liner is glued to said box.

15. The humidor of claim 10, further comprising:

a humidifier disposed therein.

16. The humidor of claim 10, and wherein:

said convex cylindrical portion is joined with said concave cylindrical portion by a substantially planar portion.

* * * * *